US009574776B2

(12) United States Patent
Buelow et al.

(10) Patent No.: US 9,574,776 B2
(45) Date of Patent: Feb. 21, 2017

(54) THREE-PIECE AIRBLAST FUEL INJECTOR

(71) Applicant: Delavan Inc., Des Moines, IA (US)

(72) Inventors: Philip Buelow, West Des Moines, IA (US); Nicole L. Nelson, Des Moines, IA (US)

(73) Assignee: Delavan Inc., Des Moines, IA (US)

( * ) Notice: Subject to any disclaimer, the term of this patent is extended or adjusted under 35 U.S.C. 154(b) by 453 days.

(21) Appl. No.: 14/191,038

(22) Filed: Feb. 26, 2014

(65) Prior Publication Data

US 2015/0108236 A1 Apr. 23, 2015

Related U.S. Application Data

(60) Provisional application No. 61/893,647, filed on Oct. 21, 2013.

(51) Int. Cl.

| | |
|---|---|
| ***F02M 53/08*** | (2006.01) |
| ***F23R 3/28*** | (2006.01) |
| ***F01N 3/025*** | (2006.01) |
| ***F23D 11/10*** | (2006.01) |
| ***F23D 11/38*** | (2006.01) |

(52) U.S. Cl.

CPC ..... *F23R 3/286* (2013.01); *F01N 3/0253* (2013.01); *F23D 11/107* (2013.01); *F23D 11/383* (2013.01); *F23R 3/283* (2013.01); *F23D 2900/11101* (2013.01)

(58) Field of Classification Search

CPC ..... F02M 53/08; F02M 53/04; F23R 3/286; F23R 3/283; F23D 11/107; F23D 11/383; F23D 2900/11101

USPC ..... 60/740, 741, 742; 239/5, 408, 403

See application file for complete search history.

(56) References Cited

U.S. PATENT DOCUMENTS

| | | | | |
|---|---|---|---|---|
| 5,570,580 | A * | 11/1996 | Mains | F23D 11/36 239/132.5 |
| 7,926,282 | B2 | 4/2011 | Chew et al. | |
| 2010/0115955 | A1* | 5/2010 | Goeke | F02C 7/228 60/740 |
| 2012/0228397 | A1* | 9/2012 | Thomson | F23R 3/28 239/13 |
| 2013/0200179 | A1* | 8/2013 | Buelow | F23D 11/383 239/463 |
| 2014/0158796 | A1* | 6/2014 | Buelow | F23R 3/28 239/468 |

* cited by examiner

*Primary Examiner* — Steven A. Reynolds
(74) *Attorney, Agent, or Firm* — Kinney & Lange, P.A.

(57) ABSTRACT

A fuel system includes an external cool air source, and a fuel injector. The fuel injector includes a fuel circuit, an outer air circuit, an inner air circuit, and an outlet. The fuel circuit receives liquid fuel from a fuel inlet. The outer air circuit receives cool air from the cool air source and substantially surrounds the fuel circuit. The inner air circuit is in fluid communication with the outer air circuit and a portion of the fuel circuit substantially surrounds the inner air circuit. The outlet provides atomized fuel from the fuel circuit, outer air circuit and inner air circuit to a combustor.

15 Claims, 5 Drawing Sheets

THREE-PIECE AIRBLAST FUEL INJECTOR

BACKGROUND

The present invention is related to fuel injectors, and in particular to an air-cooled airblast fuel injector.

In the past, standard automotive or industrial fuel injectors have been utilized, for example, within exhaust systems to provide further heat to burn off carbon for diesel particulate filters. Exhaust environments are harsh environments and the extensive heat can cause the injectors to suffer from, for example, carbon fouling which can cause malfunctions and reduce the life of the injectors. Additionally, these injectors primarily atomize the fuel using just fuel pressure, which can also increase the likelihood of carbon fouling. It is desirable to produce an affordable fuel injector that can be utilized in harsh environments such as exhaust systems.

SUMMARY

A fuel system includes an external cool air source, and a fuel injector. The fuel injector includes a fuel circuit, an outer air circuit, an inner air circuit, and an outlet. The fuel circuit receives liquid fuel from a fuel inlet. The outer air circuit receives cool air from the cool air source and substantially surrounds the fuel circuit. The inner air circuit is in fluid communication with the outer air circuit and a portion of the fuel circuit substantially surrounds the inner air circuit. The outlet provides atomized fuel from the fuel circuit, outer air circuit and inner air circuit to a combustor.

DETAILED DESCRIPTION

An airblast fuel injector utilized in harsh environments includes three piece-parts to form an injector that utilizes a source of "cool" air to provide adequate cooling to the liquid fuel circuit and provide atomization to the liquid fuel. In one embodiment, the piece-parts include a body, an air swirler, and a housing. The piece-parts define a liquid fuel delivery circuit and inner and outer air circuits. The outer air circuit substantially surrounds the fuel circuit to provide adequate shielding of heat for the liquid fuel circuit. A portion of the fuel circuit substantially surrounds the inner air circuit. The inner air circuit provides further cooling and atomization for the liquid fuel. The inner air circuit is in fluid communication with the outer air circuit. The terminal end of the fuel circuit defines a prefilmer. The prefilmer is in fluid communication with the inner and outer air circuits to effect atomization of the liquid fuel. By utilizing a source of cool air flowing through the injector to shield the liquid fuel circuit, traditional heat shields can be eliminated, reducing the overall cost of the injector.

Figure 1:
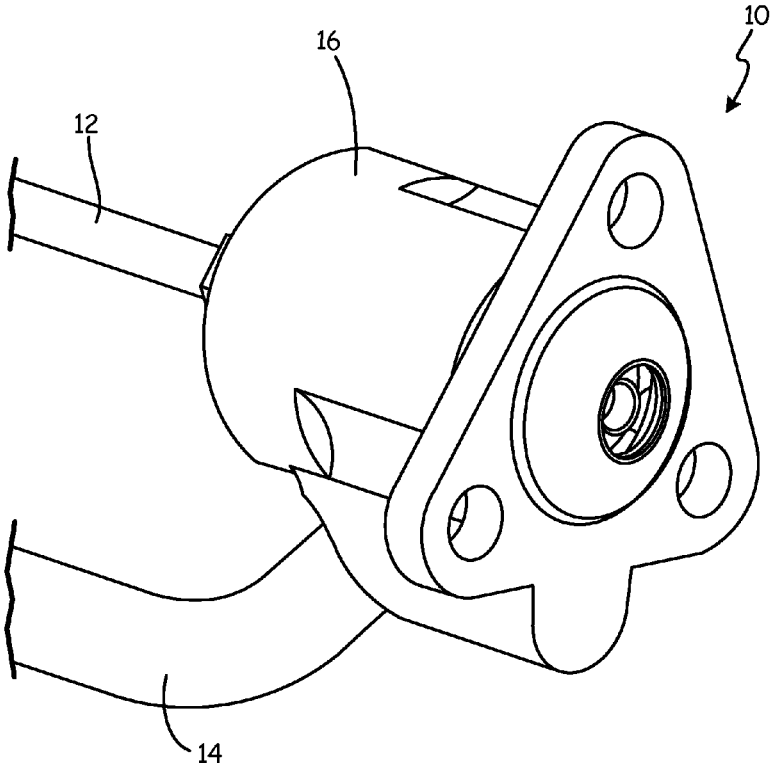
FIG. 1 is a perspective view of an airblast fuel injector.

FIG. 1 illustrates a perspective view of fuel injector 10. Fuel injector 10 includes fuel inlet 12, air inlet 14, and housing 16. Fuel injector 10 is utilized in, for example, an exhaust system of a vehicle, such as a land-based vehicle or an aircraft. These injectors are used, for example, in exhaust systems to provide additional heating to the exhaust line to burn off carbon for diesel particulates filters. Injector 10 receives liquid fuel at inlet 12 and cool air at inlet 14. The cool air is utilized to provide cooling for the fuel circuit of injector 10 and also to effect atomization of the liquid fuel. The atomized fuel is provided from the outlet of injector 10 to, for example, a combustion zone (shown in FIG. 2).

Figure 2:
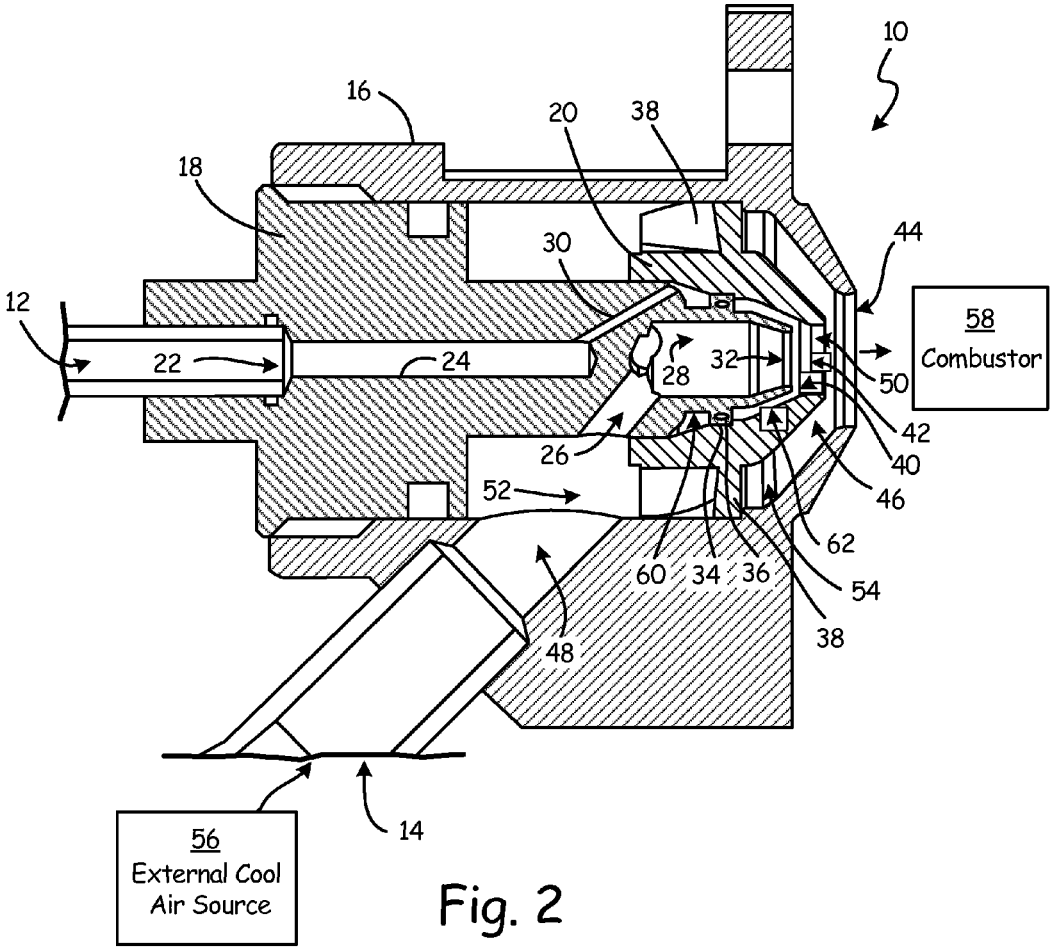
FIG. 2 is a cross-sectional view of an airblast fuel injector.

FIG. 2 illustrates a cross-sectional view of airblast fuel injector 10. Injector 10 includes housing 16, body 18, and air-swirler 20. Housing 16, body 18, and air-swirler 20 are piece-parts that are combined to assemble fuel injector 10. Body 18 includes fuel inlet 22, fuel passage 24, air inlet 26, air passage 28, fuel ports 30, air outlet 32, rim 34, and fuel ports 36. Air-swirler 20 includes vanes 38, cavity 40, and outlet 42. Housing 16 includes outlet 44, cavity 46, and inlet 48. Housing 16 may be customized to fit the application for lowest cost using any manufacturing process such as machining bar stock or machining a casting. Body 18 is received within cavity 40. Body 18 and air-swirler 20 are together received within cavity 46. The terminal end of air-swirler 20 defines prefilmer 50. Inner surfaces of housing 16 and outer surfaces of both body 18 and air-swirler 20 define air chambers 52 and 54. Cool air is received at air inlet 14 from an external air source 56 which may be, for example, an external air compressor or an external pump located on the vehicle. The cool air may be delivered, for example, through a piping system that may include, for example, heat exchangers. Atomized fuel is provided to combustor 58 from outlet 44.

Fuel is received by injector 10 from fuel inlet 12. In the embodiment shown in FIG. 2, the liquid fuel circuit of injector 10 includes fuel inlet 22, fuel passage 24, fuel ports 30, fuel chamber 60, fuel ports 36, fuel spin chamber 62, and prefilmer 50. Fuel provided from fuel inlet 12 is received within body 18 at fuel inlet 22 and provided to fuel passage 24. Fuel is provided to fuel inlet 22 from, for example, a fuel reservoir of a vehicle. Fuel flows from fuel passage 24 through fuel ports 30. Any number such as, for example, three fuel ports 30 may be included. Fuel ports 30 may be, for example, drilled holes or electric-discharge machined (EDM) holes. The liquid fuel is then received within annular fuel chamber 60 which is defined by an outer surface of body 18 and an inner surface of air swirler 20. The fuel in chamber 62 is metered and swirled by fuel ports 36 which are included within rim 34. Any number of fuel ports 36 are utilized and are, for example, drilled holes or EMD holes. Slots 36 may be angled through rim 34 in order to impart swirl to the fuel. Fuel exits slots 36 and enters spin chamber 62 defined by the converging inner surface of air-swirler 20 and a corresponding outer surface of body 18. The terminal end of air-swirler 20 defines prefilmer 50 which comprises the end of the liquid fuel circuit. Prefilmer 50 provides a film of liquid fuel to the inner and outer air circuits for atomization.

Injector 10 includes inner and outer air circuits to provide heat-shielding for the liquid fuel circuit and to provide atomization for the liquid fuel. Both outer and inner air circuits receive cool air from external cool air source 56. This air is cooler than the traditional air provided to an airblast injector from, for example, an engine internal air compressor. Because it is cooler than the air provided to traditional airblast injectors, the cool air can be used to shield the liquid fuel circuit from the heat-load, which eliminates the need for a separate heat shield piece-part. Eliminating the need for an additional heat-shield piece part reduces the overall cost of injector 10.

The outer air circuit includes annular chambers 52 and 54. Annular chamber 52 is defined by the inner surface of housing 16 and the outer surface of body 18. Chamber 52 receives cool air from air inlet 14. Chamber 52 is in fluid communication with chamber 54. Chamber 54 is defined by the converging inner surface of housing 16 and the corresponding outer surface of air-swirler 20. Vanes 38 of air-swirler 20 impart swirl to the air flowing from chamber 52 to chamber 54. While illustrated as vanes in the embodiment shown in FIG. 2, air-swirler 20 may implement other means to swirl the air from chamber 52 to chamber 54 such as, for example, a rim with drilled holes. The air from chamber 54 is provided to prefilmer 50 to atomize the liquid fuel. The outer air circuit substantially surrounds the fuel circuit to shield the fuel from the heat-load.

The inner air circuit is in fluid communication with the outer air circuit. The inner air circuit includes air inlet 26, air passage 28, and air outlet 32. Air inlet 26 receives the cool air from chamber 52. The cool air flows from air inlet 26, through air passage 28 to air outlet 32. The air from outlet 32 is provided to prefilmer 50 to effect atomization of the liquid fuel. Air passages 26 may or may not be offset from the axis of the injector in order to impart varying degrees and orientation of swirl to the inner air. The liquid fuel circuit substantially surrounds the inner air circuit, and the inner air circuit provides further cooling for the liquid fuel circuit. Another advantage of providing cool air through the inner and outer air circuits is to protect the liquid tip of the injector from exposure to downstream combustion product, soot, or other undesirable gasses which could lead to fouling of the injector tip.

Figure 3:
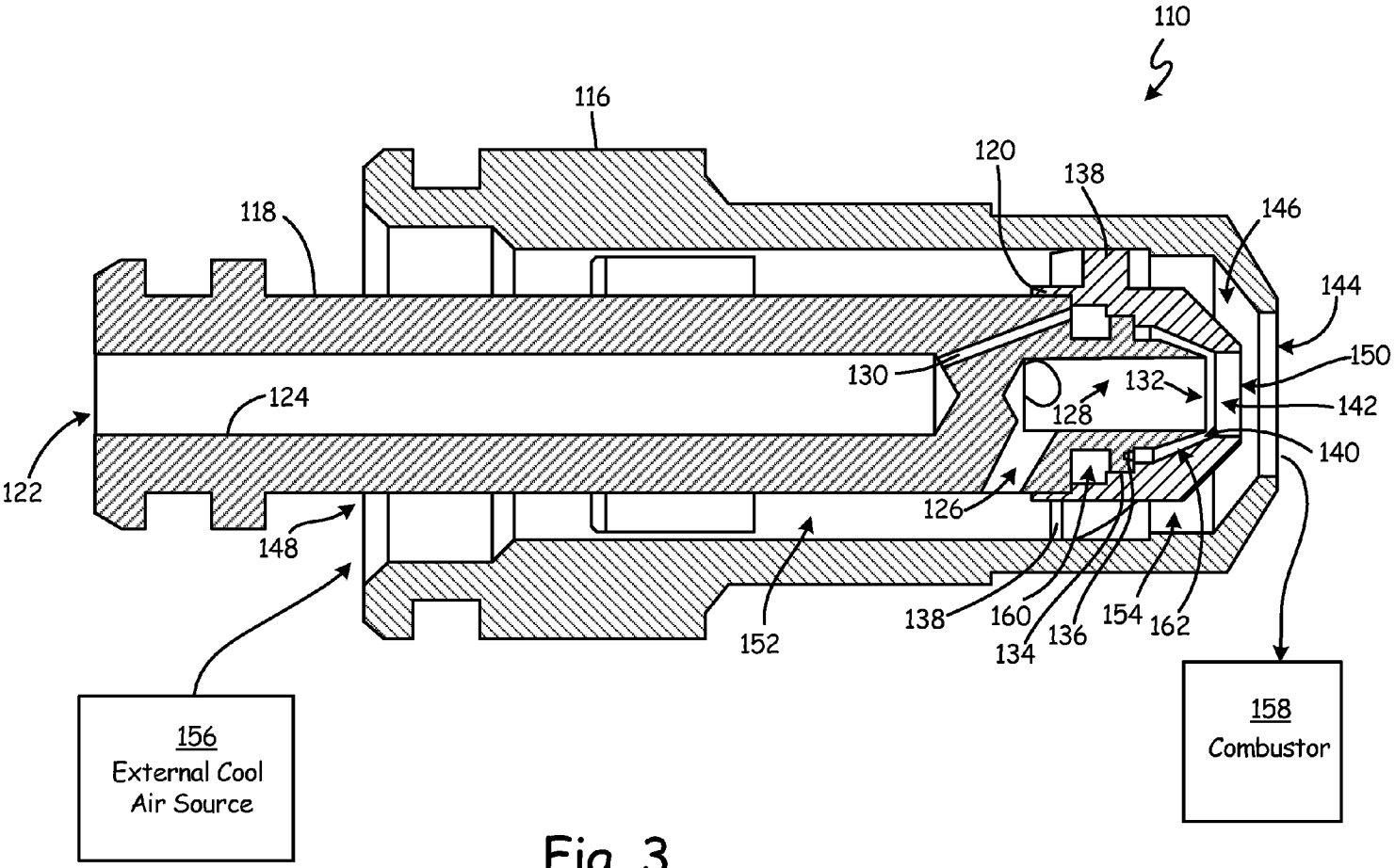
FIGS. 3, 4A and 4B illustrate a cross-sectional view and perspective views, respectively, of another embodiment of an airblast fuel injector.
Figure 4A:
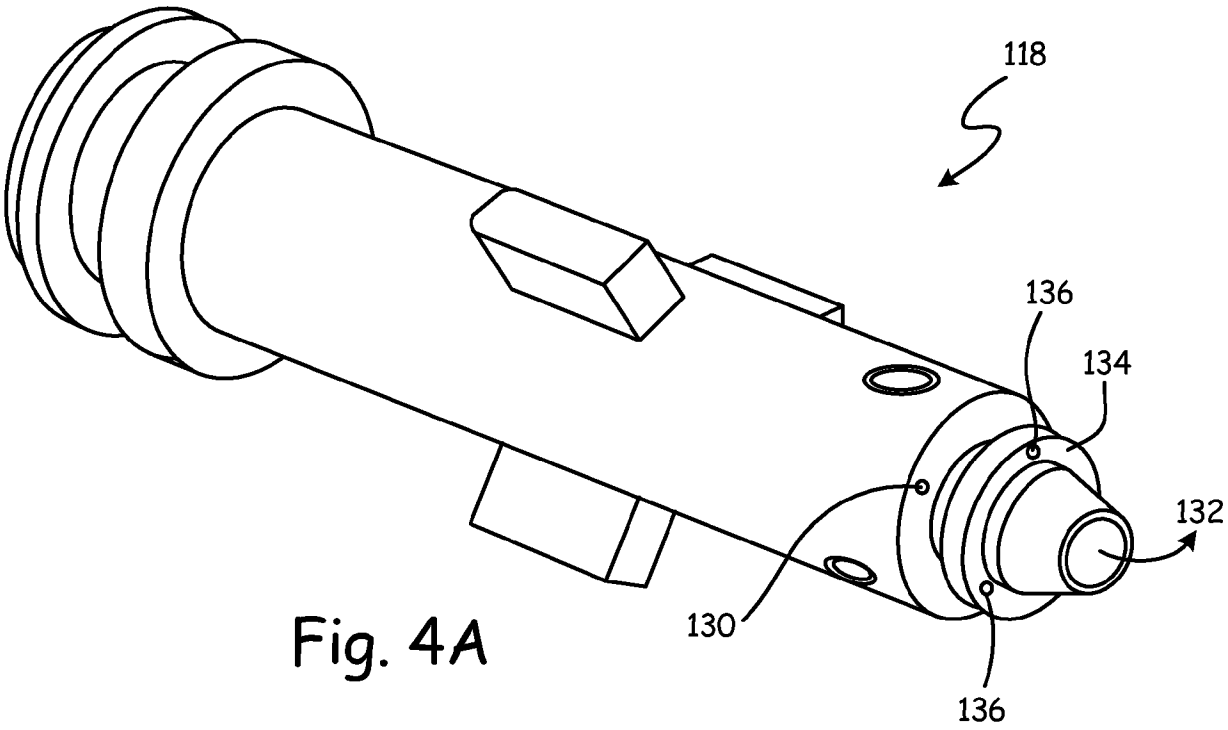
Figure 4B:
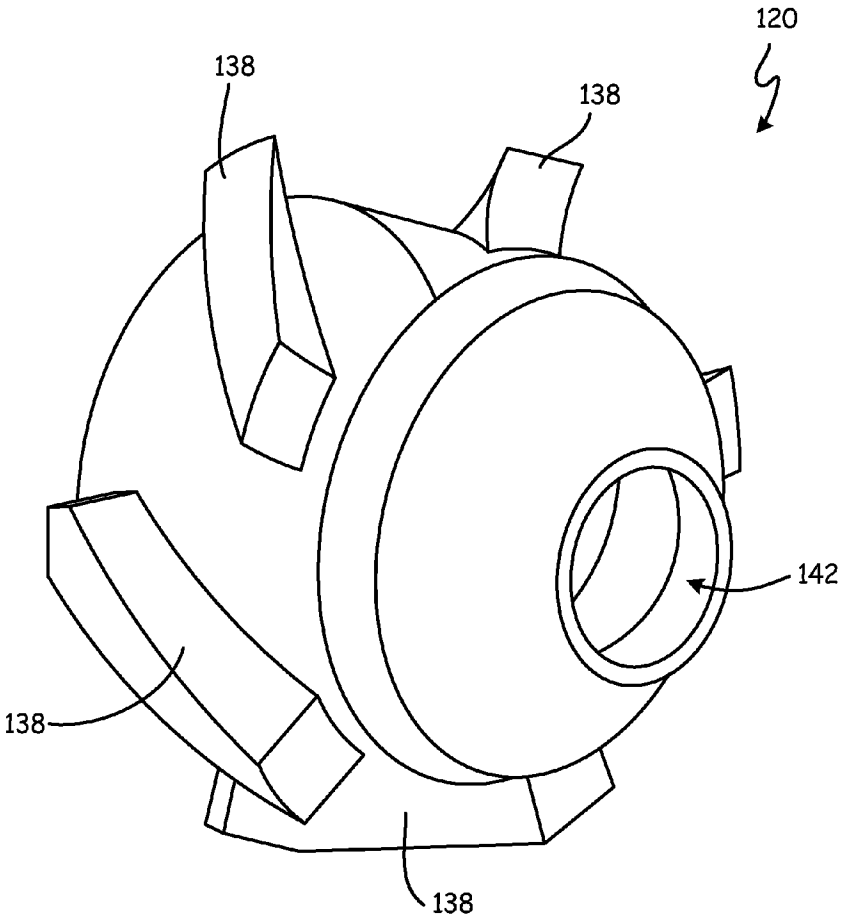

FIGS. 3, 4A and 4B illustrate a cross-sectional view and perspective views, respectively, of another embodiment of an airblast fuel injector. Injector 110 includes housing 116, body 118, and air-swirler 120. Housing 116, body 118, and air-swirler 120 are piece-parts that are combined to assemble fuel injector 110. In the embodiment shown in FIG. 3, body 118 is a screw-pin piece-part. Body 118 includes fuel inlet 122, fuel passage 124, air inlet 126, air passage 128, fuel ports 130, air outlet 132, rim 134, and fuel ports 136. Air-swirler 120 includes vanes 138, cavity 140, and outlet 142. Housing 116 includes outlet 144, cavity 146, and inlet 148. Body 118 is received within cavity 140. Body 118 and air-swirler 120 are together received within cavity 146. The terminal end of air-swirler 120 defines prefilmer 150. Inner surfaces of housing 116 and outer surfaces of both body 118 and air-swirler 120 define air chambers 152 and 154. Cool air is provided to air chamber 152 from external cool air source 156. Atomized fuel is provided to combustor 158 from outlet 144.

The embodiment shown in FIG. 3 operates in a substantially similar manner to the embodiment shown in FIGS. 1 and 2. Similar components have been labeled with numbers corresponding to those used in FIG. 2. For example, housing 116, body 118 and air-swirler 120 operate in a substantially similar way to housing 16, body 18, and air-swirler 20. While there are no system inlets shown, liquid fuel is received at body fuel inlet 122 and cool air is received from cool air source 156 at housing inlet 148. Various methods can be used to construct the three piece-parts such as, for example, casting, machining, metal-injection molding, or additive manufacturing. Injector 110 may be assembled by, for example, pressing the three components together using threading, or brazing the three components together.

Injector 110 includes a fuel circuit and inner and outer air circuits substantially similar to those shown in FIG. 2. The air circuits are utilized to provide heat-shielding for the liquid fuel circuit and to provide atomization for the liquid fuel. Both outer and inner air circuits receive cool air from external cool air source 156. Because the air is cooler than the traditional air provided to an airblast injector, the cool air can be used to shield the liquid fuel circuit from the heat-load, which eliminates the need for a separate heat shield piece-part. Eliminating the need for an additional heat-shield piece part reduces the overall cost of injector 110.

Discussion of Possible Embodiments

The following are non-exclusive descriptions of possible embodiments of the present invention.

A fuel system includes, among other things: an external cool air source, and a fuel injector. The fuel injector includes a fuel circuit, an outer air circuit, an inner air circuit, and an outlet. The fuel circuit receives liquid fuel from a fuel inlet. The outer air circuit receives cool air from the cool air source and substantially surrounds the fuel circuit. The inner air circuit is in fluid communication with the outer air circuit and a portion of the fuel circuit substantially surrounds the inner air circuit. The outlet provides atomized fuel from the fuel circuit, outer air circuit and inner air circuit to a combustor.

A further embodiment of the foregoing fuel system, wherein the fuel injector further includes a body piece-part, an air-swirler piece-part, and a housing piece-part. The fuel circuit includes a fuel passageway in the body piece-part that is in fluid communication with the fuel inlet, a fuel chamber defined between an outer surface of the body piece-part and an inner surface of the air-swirler piece-part, wherein the fuel chamber is in fluid communication with the fuel passageway, and a prefilmer in fluid communication with the fuel chamber, wherein the prefilmer is in fluid communication with the outlet.

A further embodiment of any of the foregoing fuel systems, wherein the outer air circuit includes a first air chamber defined by an inner surface of the housing piece-part and an outer surface of the body. The first air chamber is in fluid communication with the air inlet. The outer air circuit further includes a second air chamber defined by the inner surface of the housing piece-part and an outer surface of the air-swirler. The second air chamber is in fluid communication with the first air chamber and the outlet.

A further embodiment of any of the foregoing fuel systems, wherein the inner air circuit includes an inner air passage within the body that is in fluid communication with the prefilmer, and wherein the air passage is in fluid communication with the first air chamber.

A further embodiment of any of the foregoing fuel systems, wherein the inner air passage and the second air chamber provide the cool air to the prefilmer to atomize the liquid fuel.

A further embodiment of any of the foregoing fuel systems, wherein a plurality of vanes are included on the outer surface of the air-swirler piece-part to swirl the cool air from the first air chamber into the second air chamber.

A method of shielding liquid fuel in a fuel injector includes, among other things: receiving the liquid fuel at a fuel inlet of the fuel injector, wherein the fuel injector includes a fuel circuit; receiving cool air at an air inlet of the fuel injector from an external cool air source, wherein the fuel injector includes an inner air circuit and an outer air circuit, and wherein the outer air circuit substantially surrounds the fuel circuit, and wherein a portion of the fuel circuit substantially surrounds the inner air circuit; and atomizing the liquid fuel with the cool air in the inner and outer air circuits; and providing the atomized fuel to a combustor.

A further embodiment of the foregoing method, wherein the fuel injector further includes a body piece-part, an air-swirler piece-part, and a housing piece-part. The fuel circuit includes a fuel passageway in the body piece-part that is in fluid communication with the fuel inlet, a fuel chamber defined between an outer surface of the body piece-part and an inner surface of the air-swirler piece-part, wherein the fuel chamber is in fluid communication with the fuel passageway, and a prefilmer in fluid communication with the fuel chamber, wherein the prefilmer is in fluid communication with the outlet.

A further embodiment of any of the foregoing methods, wherein the outer air circuit includes a first air chamber defined by an inner surface of the housing piece-part and an outer surface of the body. The first air chamber is in fluid communication with the air inlet. The outer air circuit further includes a second air chamber defined by the inner surface of the housing piece-part and an outer surface of the air-swirler. The second air chamber is in fluid communication with the first air chamber and the outlet. Receiving cool air at an air inlet further includes providing the cool air to the first air chamber.

A further embodiment of any of the foregoing methods, wherein the inner air circuit includes an inner air passage within the body that is in fluid communication with the prefilmer, and wherein the air passage is in fluid communication with the first air chamber. Atomizing the liquid fuel comprises providing cool air from the air passage to the prefilmer.

A further embodiment of any of the foregoing methods, wherein atomizing the liquid fuel further comprises providing air from the second air chamber to the prefilmer.

A further embodiment of any of the foregoing methods, further comprising swirling the air from the first air chamber to the second air chamber using a plurality of vanes on an outer surface of the air-swirler piece-part.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A fuel system comprising:
an external cool air source; and
a fuel injector that comprises:
a fuel circuit that receives liquid fuel from a fuel inlet and provides the liquid fuel to a prefilmer;
an outer air circuit that receives cool air from the cool air source, wherein the outer air circuit substantially surrounds the fuel circuit;
an inner air circuit in fluid communication with the outer air circuit, wherein the inner air circuit receives a portion of the cool air from the outer air circuit, and wherein all the liquid fuel passes to the prefilmer through a portion of the fuel circuit that substantially surrounds the inner air circuit; and
an outlet that provides atomized fuel from the fuel circuit, outer air circuit and inner air circuit to a combustor.

2. The fuel system of claim 1, wherein the fuel injector further comprises:
a body piece-part;
an air-swirler piece-part; and
a housing piece-part; and
wherein the fuel circuit comprises:
a fuel passageway in the body piece-part that is in fluid communication with the fuel inlet; and
a fuel chamber defined between an outer surface of the body piece-part and an inner surface of the air-swirler piece-part, wherein the fuel chamber is in fluid communication with the fuel passageway; and
wherein the prefilmer is in fluid communication with the fuel chamber, wherein the prefilmer is in fluid communication with the outlet.

3. The fuel system of claim 2, wherein the outer air circuit comprises:
a first air chamber defined by an inner surface of the housing piece-part and an outer surface of the body, wherein the first air chamber is in fluid communication with the air inlet; and
a second air chamber defined by the inner surface of the housing piece-part and an outer surface of the air-swirler, wherein the second air chamber is in fluid communication with the first air chamber and the outlet.

4. The fuel system of claim 3, wherein the inner air circuit comprises:
an inner air passage within the body that is in fluid communication with the prefilmer, and wherein the inner air passage is in fluid communication with the first air chamber.

5. The fuel system of claim 4, wherein the inner air passage and the second air chamber provide the cool air to the prefilmer to atomize the liquid fuel.

6. The fuel system of claim 3, wherein a plurality of vanes are included on the outer surface of the air-swirler piece-part to swirl the cool air from the first air chamber into the second air chamber.

7. A method of shielding liquid fuel in a fuel injector, the method comprising:
receiving the liquid fuel at a fuel inlet of the fuel injector, wherein the fuel injector includes a fuel circuit;
receiving cool air at an air inlet of the fuel injector from an external cool air source, wherein the fuel injector includes an inner air circuit and an outer air circuit, and wherein the outer air circuit substantially surrounds the fuel circuit, and wherein a portion of the fuel circuit substantially surrounds the inner air circuit;
providing all the liquid fuel to a prefilmer through the portion of the fuel circuit that substantially surrounds the inner air circuit;
providing, by the outer air circuit, a portion of the cool air to the inner air circuit;
atomizing the liquid fuel with the cool air in the inner and outer air circuits; and
providing the atomized fuel to a combustor.

8. The method of claim 7, wherein the fuel injector further comprises:
a body piece-part;
an air-swirler piece-part; and
a housing piece-part; and
wherein the fuel circuit comprises:
a fuel passageway in the body piece-part that is in fluid communication with the fuel inlet;
a fuel chamber defined between an outer surface of the body piece-part and an inner surface of the air-swirler piece-part, wherein the fuel chamber is in fluid communication with the fuel passageway; and wherein the prefilmer is in fluid communication with the fuel chamber, wherein the prefilmer is in fluid communication with the outlet.

9. The method of claim 8, wherein the outer air circuit comprises:

a first air chamber defined by an inner surface of the housing piece-part and an outer surface of the body, wherein the first air chamber is in fluid communication with the air inlet; and a second air chamber defined by the inner surface of the housing piece-part and an outer surface of the air-swirler, wherein the second air chamber is in fluid communication with the first air chamber and the outlet; and wherein receiving cool air at an air inlet further comprises providing the cool air to the first air chamber.

10. The method of claim 9, wherein the inner air circuit comprises:

an inner air passage within the body that is in fluid communication with the prefilmer, and wherein the inner air passage is in fluid communication with the first air chamber; and wherein atomizing the liquid fuel comprises providing cool air from the inner air passage to the prefilmer.

11. The method of claim 10, wherein atomizing the liquid fuel further comprises providing air from the second air chamber to the prefilmer.

12. The method claim 9, further comprising swirling the air from the first air chamber to the second air chamber using a plurality of vanes on an outer surface of the air-swirler piece-part.

13. A fuel system comprising:

an external cool air source; and a fuel injector that comprises:

a body piece-part;

an air-swirler piece-part;

a housing piece-part;

a fuel circuit that receives liquid fuel from a fuel inlet, wherein the fuel circuit comprises:

a fuel passageway in the body piece-part that is in fluid communication with the fuel inlet;

a fuel chamber defined between an outer surface of the body piece-part and an inner surface of the air-swirler piece-part, wherein the fuel chamber is in fluid communication with the fuel passageway; and a prefilmer in fluid communication with the fuel chamber, wherein the prefilmer is in fluid communication with an outlet;

an outer air circuit that receives cool air from the cool air source, wherein the outer air circuit substantially surrounds the fuel circuit, and wherein the outer air circuit comprises:

a first air chamber defined by an inner surface of the housing piece-part and an outer surface of the body, wherein the first air chamber is in fluid communication with the air inlet; and a second air chamber defined by the inner surface of the housing piece-part and an outer surface of the air-swirler, wherein the second air chamber is in fluid communication with the first air chamber and the outlet; and an inner air circuit in fluid communication with the outer air circuit, wherein a portion of the fuel circuit substantially surrounds the inner air circuit, wherein the inner air circuit comprises an inner air passage within the body that is in fluid communication with the prefilmer, and wherein the inner air passage is in fluid communication with the first air chamber;

wherein the outlet provides atomized fuel from the fuel circuit, outer air circuit and inner air circuit to a combustor.

14. The fuel system of claim 13, wherein the inner air passage and the second air chamber provide the cool air to the prefilmer to atomize the liquid fuel.

15. The fuel system of claim 13, wherein a plurality of vanes are included on the outer surface of the air-swirler piece-part to swirl the cool air from the first air chamber into the second air chamber.

* * * * *